United States Patent [19]

Uda et al.

[11] Patent Number: 4,740,730

[45] Date of Patent: Apr. 26, 1988

[54] APPARATUS FOR DETECTING LOW-SPEED ELECTRONS

[75] Inventors: Masayuki Uda, Tokyo; Yoshinori Shirahashi, Omiya, both of Japan

[73] Assignees: Riken Keiki Co., Ltd.; Rikagaku Kenkyusho, both of Tokyo, Japan

[21] Appl. No.: 819,226

[22] Filed: Jan. 15, 1986

[30] Foreign Application Priority Data

Jan. 16, 1985 [JP] Japan ..... 60-5471
Apr. 15, 1985 [JP] Japan ..... 60-80891
Apr. 15, 1985 [JP] Japan ..... 60-80892

[51] Int. Cl.[4] ..... H01J 17/36

[52] U.S. Cl. ..... 315/84.51; 315/111.41; 315/111.21; 315/340; 324/71.3; 324/71.4; 250/492.1

[58] Field of Search ..... 315/8.5, 8.6, 84.51, 315/84.61, 112, 117, 340, 111.21, 111.41; 324/71.3, 71.4; 250/492.1

[56] References Cited

U.S. PATENT DOCUMENTS 2,792,526 5/1957 Warman ..... 313/589 X
3,088,074 4/1963 Ross ..... 315/340 X
3,526,828 8/1967 Whitby ..... 324/71.4
4,153,844 5/1979 Kirschner ..... 250/492.1

*Primary Examiner*—Saxfield Chatmon
*Attorney, Agent, or Firm*—Burgess, Ryan & Wayne

[57] ABSTRACT

An apparatus capable of detecting the low-speed electrons (photo-electrons, exo-electrons) emitted from an object with increased accuracy, regardless of the condition of operating environment is disclosed. The apparatus consists in the main of a bell-shaped cathode opened to the atmosphere at the bottom thereof, and an anode supported within the cathode. The anode is supplied with a high voltage enough to induce a gaseous discharge upon the entrance of the low-speed electrons into the cathode, and the number of pulses generated by the anode as a result of this gaseous discharge is counted. Also, a sensor is provided to detect the condition of the operating environment and outputs a signal indicative of the condition. This signal is used to adjust the condition for gaseous discharge across the anode and the cathode to thereby maintain a constant counting rate.

12 Claims, 14 Drawing Sheets

APPARATUS FOR DETECTING LOW-SPEED ELECTRONS

BACKGROUND OF THE INVENTION (1) Field of the Invention

This invention relates in general to an apparatus for detecting photo-electrons, thermions, and exo-electrons characterized by low values of energy that are less than 10 electron-volts and in particular to such an apparatus capable of detection without primary ionization on the entrance of such low-speed electrons into the detection field.

(2) Description of the Prior Art

A typical apparatus for detecting photo-electrons, thormions, and exo-electrons, hereinafter referred together to as "low-speed electrons", in the prior art is disclosed in published Japanese patent application No. 52-7785. This apparatus consists of a bell-shaped cathode with an inter-electrode space opened to the atmosphere through an opening formed at the bottom of the cathode, an anode supported in the inter-electrode space of the cathode, and a pair of first and second grids that are situated in a vertically spaced-apart relationship above the cathode opening.

With this arrangement, the potential across the cathode and anode is normally maintained at around 3.4 kilovolts. The first grid and the second grid are connected to voltage sources of 100 volts and 80 volts, respectively.

The specimen to be measured by the apparatus is placed below the low grid. The low-speed electrons emitted from the surface of the specimen, upon entering into the inter-electrode space of the cathode through the two grids, triggers a gaseous discharge there causing the anode to generate pulses. Since the pulses thus generated from the anode are proportional to the low-speed electrons emitted from the specimen, counting means counts them as a function of the number of low-speed electrons.

Also, it is so designed that, when the interelectrode space assumes, owing to this gaseous discharge, such a state that defeats the capacity of the detector to detect, the first grid is connected to an additional source for a higher voltage that acts to extinguish the gaseous discharge. Further, the voltage of the second grid is reduced to a negative level which acts to neutralize the positive ions generated in the gaseous discharge. In this way, the detector restores its initial optimum operating condition. This process continues to repeat until the detection is completed.

However, the prior art apparatus of this type have been found to pose a serious problem, because of their designs that the inter-electrode space of the bell-shaped cathode is in free communication with the atmosphere. Since the counting rate or the number of pulses generated by the anode at gaseous discharge, as observed by counting means, varies with changes in ambient temperature and atmospheric pressure, the detection accuracy of the apparatus is affected by the conditions of the operating environment, in an extreme case, to altogether unreliable degrees.

SUMMARY OF THE INVENTION

The present invention contemplates to eliminate the above-mentioned drawbacks of difficulty of the prior art apparatus for low-speed electron detection.

It is therefore a primary object of the present invention to provide an apparatus for detecting low-speed electrons which can operate with increased measuring accuracy, regardless of the conditions of the detection environment.

The above and other objects, features and advantages of the present invention are achieved by the design of the apparatus that, in one preferred embodiment, includes means to control the temperature of both the anode and its surrounding area within the inter-electrode space in response to various factors which might affect counting rate.

In another embodiment of this invention, the apparatus has a single means for monitoring the conditions of the operating environment in a general manner.

In a third preferred embodiment, it is so designed that the apparatus is automatically capable of monitoring the conditions of the operating environment itself.

DETAILED DESCRIPTION OF THE DMBODIMENTS

Figure 1:
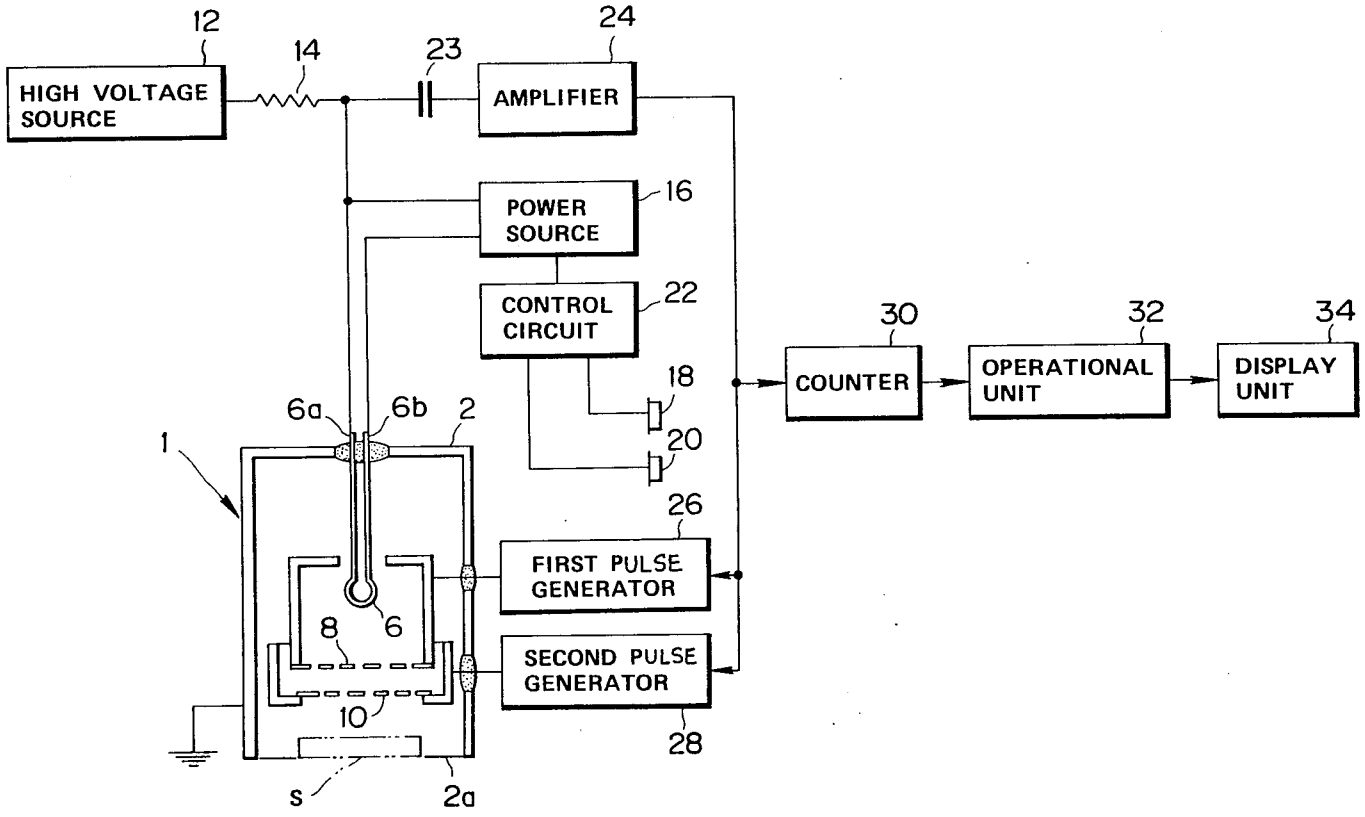
FIG. 1 is a block diagram of an apparatus for detecting low-speed electrons according to a first preferred embodiment of the present invention.

In FIG. 1, an apparatus for detecting low-speed electrons, generally designated at 1, according to the present invention is shown schematically, and includes a bell-shaped cathode 2 with an inter-electrode space opened to the atmosphere through an opening 2*a* defined at the bottom thereof. The cathode 2 is grounded at a lower end thereof. Within the inter-electrode space of the cathode 2 is supported a largely ring shaped anode 6 made of conductive wire. Also, a first grid 8 and a second grid 10 are provided mounted in a vertically spaced apart relationship below the anode 6. In addition, the anode 6 has a pair of elongate terminals 6*a* and 6*b* that extend through the cathode 2. Both of the terminals 6*a* and 6*b* are connected to a power source 16 which supplies electric power to heat the anode 6. The source 16 is connected to a control circuit 22 which controls the output of the source 16 to thereby control the temperature of the anode 6 in a manner as will later be described.

The terminal 6*a* of the anode 6 is connected to a high voltage source 12 through a load resistance 14. The source 12 is adapted to supply to the anode 6 around 3.4 kilovolts, the level that causes gaseous discharge at a certain known counting rate upon the entrance of low-speed electrons under a normal ambient operating condition, as indicated by curves II of FIGS. 10(*a*) and 10(*b*).

The control circuit 22 is connected to both an atmospheric pressure sensor 18 and an ambient temperature sensor 20. These sensors both constantly monitor the ambient conditions during operation and convert the monitored atmospheric pressure and the ambient temperature to an electric signal, respectively. Thus, the control circuit 22 can provide anode temperature control in response to the output signals from the sensors 18 and 20.

Under the aforesaid normal ambient condition, the first grid 8 is normally supplied with a voltage, for example, of 100 volts. Also, the second grid 10 is normally fed with a voltage, for example of 80 volts.

The anode 6 is connected through a capacitor 23 to an amplifier 24 which amplifies the pulses generated by the anode 6. The amplifier 24 is connected at its output to both a first pulse generator 26 and a second pulse generator 28.

The first pulse generator 26 is connected to the first grid 8 and outputs, on sensing the voltage drop of the anode 6 as a result of gaseous discharge, a control pulse signal which increases the first grid in voltage. Also, the second pulse generator 28 is connected to the second grid 10 and likewise outputs a control pulse signal which reduces the second grid 10 in voltage.

The amplifier 24 is connected to a counter 30 which counts the amplified pulses that are generated by the anode 6. The counter 30 is connected at this output to an operational circuit 32 which determines the number of low-speed electrons emitted from the specimen S into the inter-electrode space of the cathode 2, based on the counted anode pulses with correction for lost pulses during the periods of discharge extinction. A display unit 34, such as a CRT or a printer, may preferably be connected to the operational circuit 32 to display the results of computation.

With the above construction, operation of the detector 1 will be described.

Assuming that the detector 1 is operated to measure the low-speed electrons emitted from the specimen S, the anode 6 starts to be supplied with a DC voltage, for example, of 3.4 kilovolts by the high voltage source 12 and is also heated to a temperature, for example of 100° C. by the power source 16. The specimen S is set in place adjacent to the opening 2*a* of the cathode 2.

The low-speed electrons emitted from the surface of the speciment S pass through the second grid 10 and the first grid 8 and move toward the anode 6, being pulled by the attractive forces exerted by the latter. These electrons, upon entering the strong electric field of the anode 6, are accelerated further to trigger gasesous discharge in the inter-electron space of the cathode 2.

Figure 2:
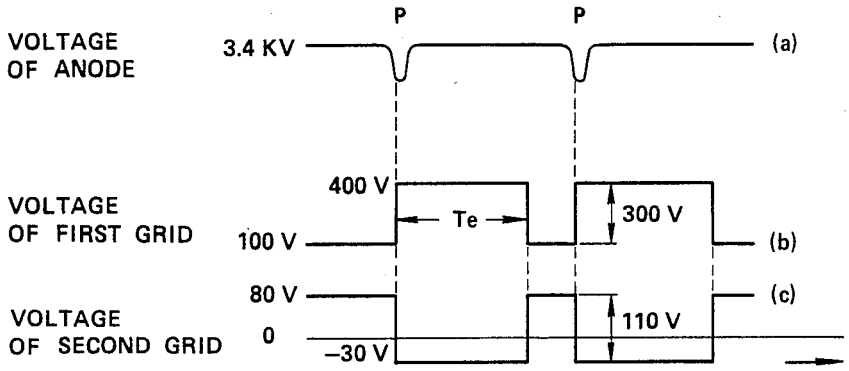
FIG. 2 presents a diagrammatic representation of the operation of the apparatus shown in FIG. 1.

This gaseous discharge accompanies gas multiplication with a resultant reduction in voltage of the anode 6, as indicated by curve (a) of FIG. 2, causing the anode 6 to generate a series of pulses P. These pulses are transmitted to the amplifier 24 through the capacitor 23, then to the first and second pulse generators 26 and 28.

As a result, the first pulse generator 26 sends a control pulse signal of 300 volts for time interval Te to the first grid 8 increasing its voltage from normal 100 volts to 400 volts for the same period of time Te, as indicated by curve (b) of FIG. 2. The increased voltage level of the first grid 8 acts to prevent the secondary electrons produced by the gas multiplication, such as photo-electrons and positive ions, from reaching discharge voltage, thereby allowing the gaseous discharge to extinguish. On the other hand, the second pulse generator 28 outputs a control pulse signal of −110 volts for time interval Te to the second grid 10 reducing its voltage from normal 80 volts to −30 volts for the same period of time Te, as indicated by curve (c) of FIG. 2. The negative voltage level of the second grid 10 acts to neutralize the positive ions in the inter-electrode space of the cathode 2. As a consequence, the detector 1 can bring the anode 6 to its initial anode voltage of 3.4 kilovolts which insures accurate measurement at the same counting rate. Thus, the detector 1 can continue to detect the low-speed electrons further emitted from the specimen S.

The pulses generated by the anode 6 during gaseous discharge are also sent, after having been amplified by the amplifier 24, to the counter 30 which in turn informs the operational circuit 32 of the count. The operational circuit 32 then determinès the total number of emitted specimen S low-speed electrons, based on the count by the counter 30, with correction for lost pulses during the periods of gaseous discharge extinction. The display unit 34 displays the results of computation of the operational circuit 32.

It has been proved that counting rate is subject to vary with changes in ambient temperatrure and atmospheric pressure. Consequently, the measuring accuracy of the detector 1 is affected by changes in the condition of the room or environment in which it is operated, unless the counting rate is constantly changed every time a material change occurs in ambient temperature or atmospheric pressure.

In more detail, the inter-molecular distance in the atmosphere increases with rising temperature and lowering atmospheric pressure, with the result that the electrons and negative ions can become more active to move. Thus, incoming electrons and negative ions come to have less dispersion with more increased likeliness to cause gaseous discharge owing to the activated surrounding molecules.

On the other hand, when the ambient temperature drops or when the atmsopheric pressure rises, on the contrary, dispersion of the incoming electrons and negative ions increases in the inactivated surrounding molecules such that gaseous discharge becomes proportionally less likely to take place.

The ambient temperature sensor 18 and the atmospheric pressure sensor 20 are provided in the detector 1 to detect changes in the ambient condition of the operating environment tha might affect counting rate. These sensors 18 and 20 send an electrical signal representative of such change to the controls circuit 22 which in turn control the source 16 to reduce the temperature of the anode 6 when the ambient temperature rises or when the atmospheric pressure drops. In this way, gaseous discharge within the inter-electrode space of the cathode 2 is limited within a predetermined range of counting rate.

Although, in this particular embodiment, the detector 1 has means both for monitoring the atmospheric pressure and the ambient temperature, control of the source 16 may be limited to employment of either of them alone.

Figure 6:
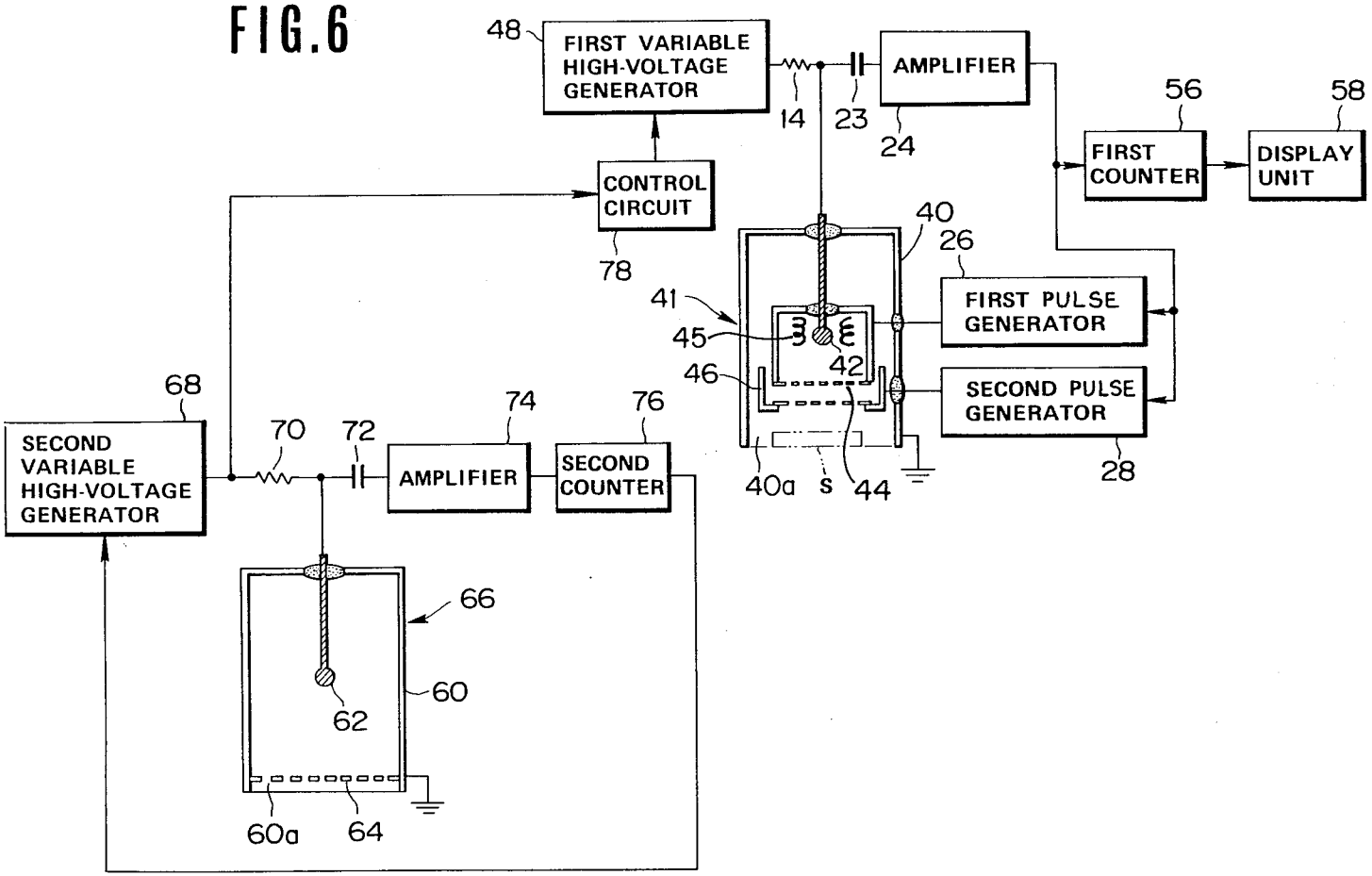
FIG. 6 is a block diagram of an apparatus for detecting low-speed electrons according to a second preferred embodiment of the present invention.

In FIG. 6, an apparatus for detecting low-speed electrons, generally designated at 41, according to a second preferred embodiment of the present invention is shown, which includes a largely bell-shaped cathode 40 having therein an inter-electrode space that is opened to the atmosphere through an opening 40*a* defined at the bottom thereof. Within the space of the cathode 40 is supported an anode 42 which is adapted to generate a non-uniform electric field in that space. Also, a first grid 44 and a second grid 46 are provided mounted in a vertically spaced-apart above the opening 40*a*. A first variable high-voltage generator 48 is connected to the anode 42 through a load resistance 14 and is provided to supply the anode 42 with a high voltage which enables the anode 42 to sustain a strong electric field enough to induce in the inter-electrode space of the cathode 2 gaseous discharge in the presence of a low-speed electron.

Also, the anode 42 is connected through a direct current blocking capacitor 23 to an amplifier 24, which in turn is connected at its output to a first counter 56 and, through the counter 56, to a display unit 58. The display unit 58 is provided to display the numbers of emitted low-speed electrons in conjunction with the counter 56. A heater 45 mounted adjacent to the anode 42 can be provided for heating the same.

The first grid 44 is connected to a first pulse generator 26 which normally supplies the first grid 44 with a voltage of around 100 volts. The first grid 44 is designed to be supplied with a higher voltage of around 400 volts for time interval Te in response to a pulse signal output from the amplifier 24. On the other hand, the second grid 46 is connected to a second pulse generator 28 which normally supplies the grid 46 with a voltage of around 80 volts. Similarly, when the amplifier 24 sends a pulse signal to the second pulse generator 28, the second grid 46 is supplied with a negative voltage of −30 volts.

Externally connected to the detector 41 is an ambient condition detector 66 which monitors the condition of the operating environment. The detector 66 consists in the main of a bell-shaped cathode 60 having therein an inter-electrode space that is opened to the atmosphere through an opening 60*a* defined at the bottom thereof, an anode 62 supported in the space of the cathode 60, and a grid 64 conductively connected to the cathode 60 adjacent to the opening 60*a*.

The grid 64 is mounted in such a manner that the cathode 60 has its inter-electrode space placed in free communication with the atmosphere while preventing entrance of free electrons into that space. A second variable high-voltage generator 68 is provided in connection to the anode 62 through a load resistance 70. Also, the second variable high-voltage generator 68 is connected to a control circuit 78 which will later be described in more detail. In addition, the second variable high-voltage generator 68 is connected through a direct current blocking capacitor 72 and an amplifier 74 to a second counter 76 which counts the number of pulses generated by the anode 62 when gaseous discharge occurs inside the inter-electrode space of the cathode 60.

Figure 7:
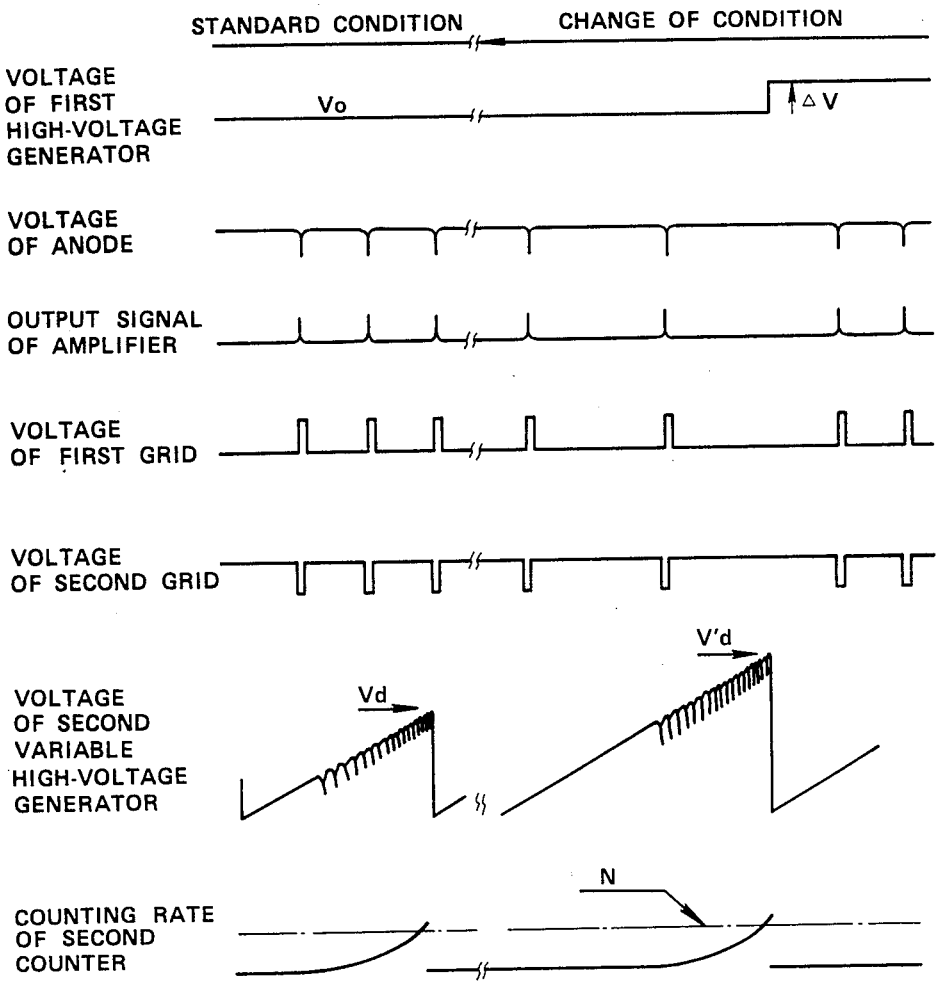
FIG. 7 is a diagrammatic representation of the operation of the apparatus illustrated in FIG. 6.

Also, the second variable high-voltage generator 68 is designed to sweep a range of voltages output therefrom to the anode 62 and stop the sweep when the second counter 76 reaches a predetermined counting rate N. The second variable high-voltage generator 68 then outputs to the control circuit 78 a voltage signal indicative of the voltage level Vd on which the circuit 68 fell just at the moment when it stopped its sweep, as indicated in FIG. 7.

The control circuit 78, in response to the output signal from the second variable high-voltage generator 68, controls the first variable high-voltage generator 48 to output to the anode 42 of the low-speed electron detector 41 a voltage that insures a particular counting rate.

With the above construction, operation of the apparatus according to the second embodiment will be described in reference to FIG. 7.

The low-speed electrons emerging from the surface of the specimen S, which is placed below the opening 40*a* of the cathode 40, being pulled by the attractive forces exerted by the anode 42, move through the second grid 46 and the first grid 44 toward the anode 42. These low-speed electrons, upon entering into the strong electric field of the anode 42, are accelerated to such a degree that ionizes the surrounding molecules, causing a gaseous discharge in the space of the cathode 40.

As a result, the anode 42 drops in voltage abruptly, generating a series of pulses. The first counter 56 counts these anode pulses and the display unit 58 displays the number of emitted specimen low-speed electrons.

Also, these anode pulses are fed to both the first and second pulse generatores 26 and 28. As a result, the first pulse generator 26 changes the output voltage level to the first grid 44 to 400 volts that is supplied for time interval Te. Further, the second pulse generator 28 comes to supply the second grid 46 with a negative voltage of −30 volts for time interval Te, instead of the normal 110 volts. Thus, the increased voltage of the first grid 44 acts to extinguish the gaseous discharge in the space of the cathode 40. On the other hand, the negative voltage of the second grid 46 neutralizes the positive ions produced in the space as a result of gaseous discharge.

The low-speed electron detector 41 causes the anode 42 to assume its original voltage for further proper detection at the end of time interval Te when the first and second grids 44 and 46 come to supply their normal voltage levels, 100 volts and 80 volts, respectively.

The mechanism of the ambient condition detector 66 will be described in more detail.

Under a standard ambient condition (20° C. in temperature and 760 mmHg in atmospheric pressure), the gaseous discharge occurs at a counting rate determined by curves II in FIGS. 11(*a*) and 11(*b*), varying depending on the voltage to the anode 62. Whenever the second counter 76 reaches a predetermined counting rate of anode pulses, hence a certain counting rate, the second variable high-voltage generator 68 outputs a voltage Vd to the control circuit 78 which in turn controls the first variable high-voltage generator 48 to maintain its initial output voltage Vo.

Figure 10A:
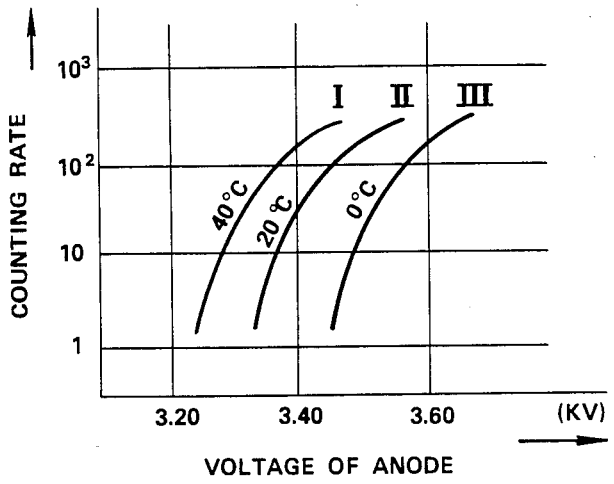
FIGS. 10*a* and 10*b* show in two diagrams the relationships between counting rate and detector anode voltage at different ambient temperatures I, II, and III (diagram "a") and different atmospheric pressures I, II, and III (diagram "b")
Figure 10B:
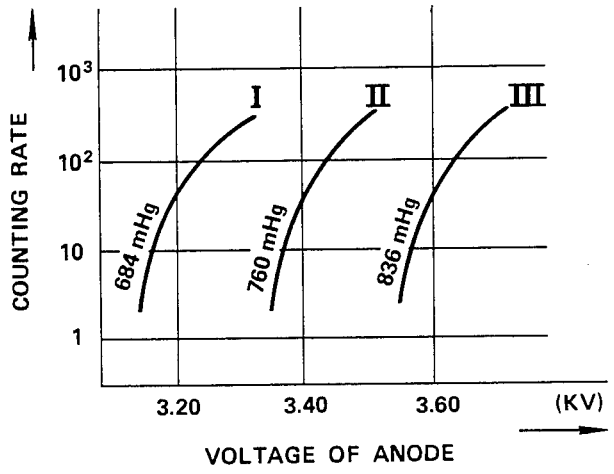

Assume now that the ambient temperature and the atmospheric pressure change to 0° C. and 836 mmHg, respectively, affecting the anode 42 of the detector 41 such that the same counting rate requires a higher anode voltage than under the standard ambient condition, as will be seen from comparison of curves II and III in FIGS. 10(*a*) and 10(*b*).

However, it is so designed that the ambient condition detector 66, with the inter-electrode space of the cathode 60 being exposed to the same operating environment as the detector 41, in response to these changes of ambient temperature and atmospheric pressure, can control the first variable high-voltage generator 48 to output to the anode 42 of the detector 41 an increased voltage Vd'. Consequently, the low-speed electron detector 41 can operate with the same counting rate.

Figure 11A:
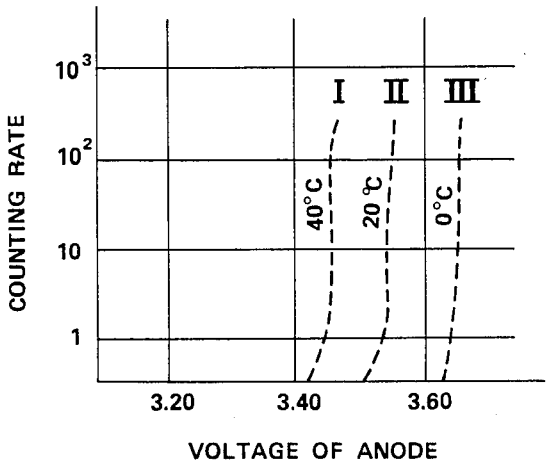
FIGS. 11*a* and 11*b* show in two diagrams the relationships between counting rate and ambient condition detector anode voltage at different ambient temperatures I, II, and III (diagram "a") and at different atmospheric pressures I, II, and III (diagram "b")
Figure 11B:
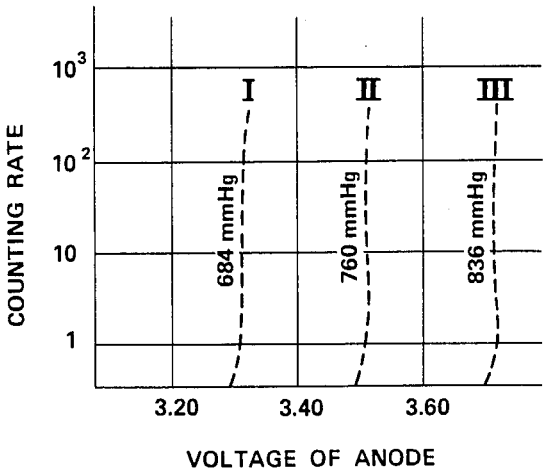

In more detail, as indicated by curves III of FIGS. 11*a* and 11*b*, since the gaseous discharge in the ambient condition detector 66 occurs at higher anode voltages, the output voltage that is produced by the second variable high-voltage generator 68 when the second counter 76 reaches its predetermined rate N, is consequently a higher level Vd' that is substantially proportional to the change in the ambient operating condition.

The control circuit 78, in response to the output Vd' from the second variable high-voltage generator 68, adjusts the ouptut of the first variable high-voltage generator 48 by increasing it by $\Delta V$ ($=Vd'-Vd$).

In this manner, the low-speed electron detector 41 can operate with a particular constant counting rate that is maintained in conjunction with the ambient condition detector 66 and the control circuit 78, regardless of changes in ambient temperature and atmospheric pressure.

Figure 8:
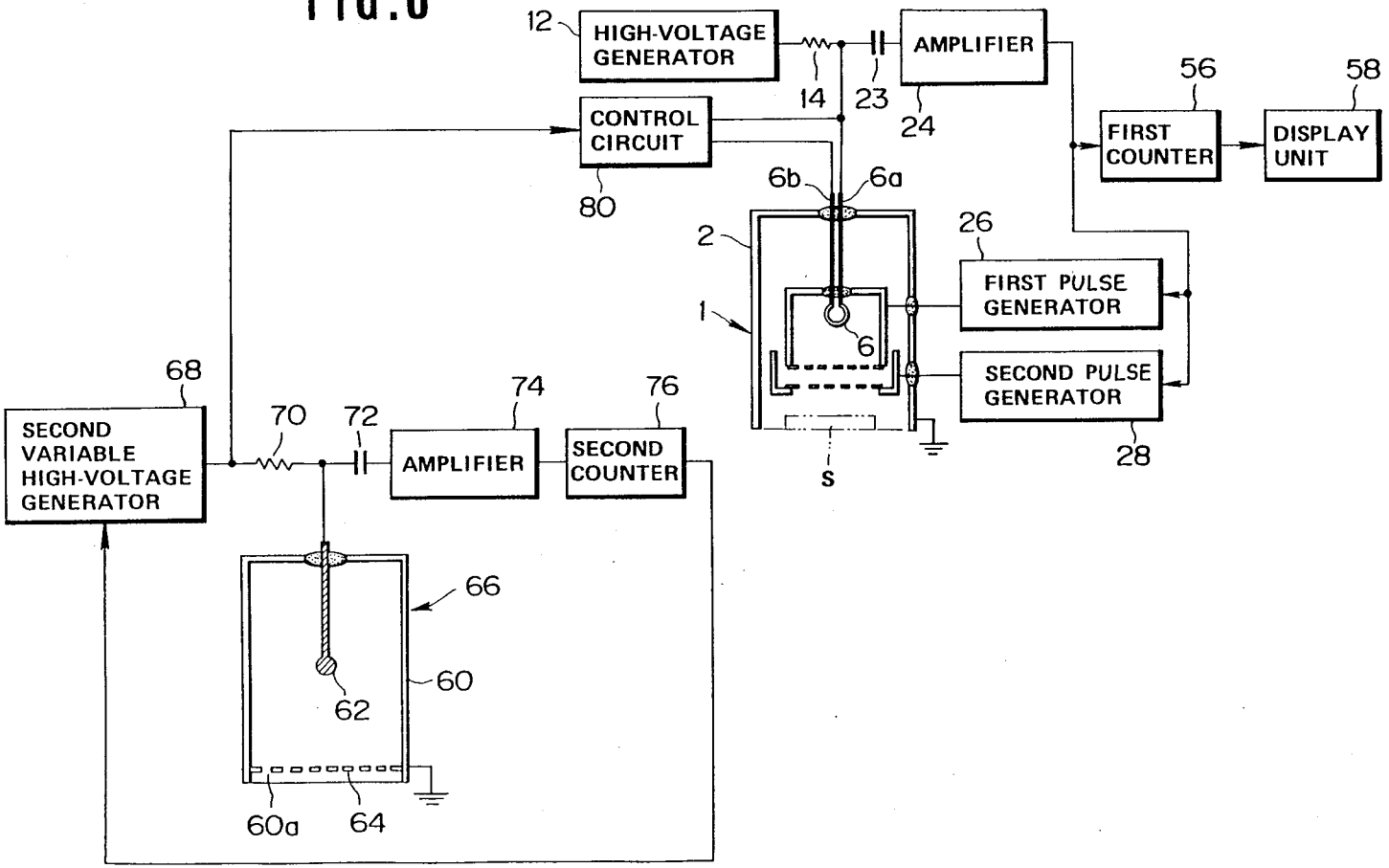
FIG. 8 is a block diagram of an apparatus for detecting low-speed electrons accoridng to a third preferred embodiment of the present invention.

In FIG. 8, an apparatus for low-speed electron detection 1 according to a third preferred embodiment of the present invention is shown which is substantially similar in construction to the apparatus of the first embodiment shown in FIG. 1. The detector 1 consists in the main of a bell-shaped cathode 2 having therein an inter-electrode space opened to the atmosphere at the bottom thereof and a ring-shaped anode 6 supported in the space of the cathode 2.

The anode 6 has a pair of terminals 6*a* and 6*b* and is connected through the terminals to a control circuit 80 which supplies the anode with electric power to heat it by the joule effect. Also, the anode 6 is connected through its one terminal 6*a* to a high-voltage generator 12 which supplies the anode 6 with a voltage that sustains in the inter-electrode space a strong electric field enough to cause gaseous discharge upon the entrance of low-speed electrons into that space. In addition, the anode 6 is connected to an amplifier 24 through a capacitor 23.

The control circuit 80 is connected to an ambient condition detector 66 for monitoring the ambient temperature and the atmospheric pressure similar in construction to the ambient condition detector of the second embodiment shown in FIG. 6. The detector 66 includes a second counter 76 which counts the pulses generated at the anode 62 when gaseous discharge occurs in the inter-electrode space of the cathode 60. When the counter reaches a predetermined rate N, the second variable high-voltage generator 68 outputs a voltage Vd that is a function of the voltage that triggered the gaseous discharge at the anode 62 to the control circuit 80 which in turn controls the output of the high-voltage generator 12 to the anode 6 to maintain the same counting rate.

Figure 9:
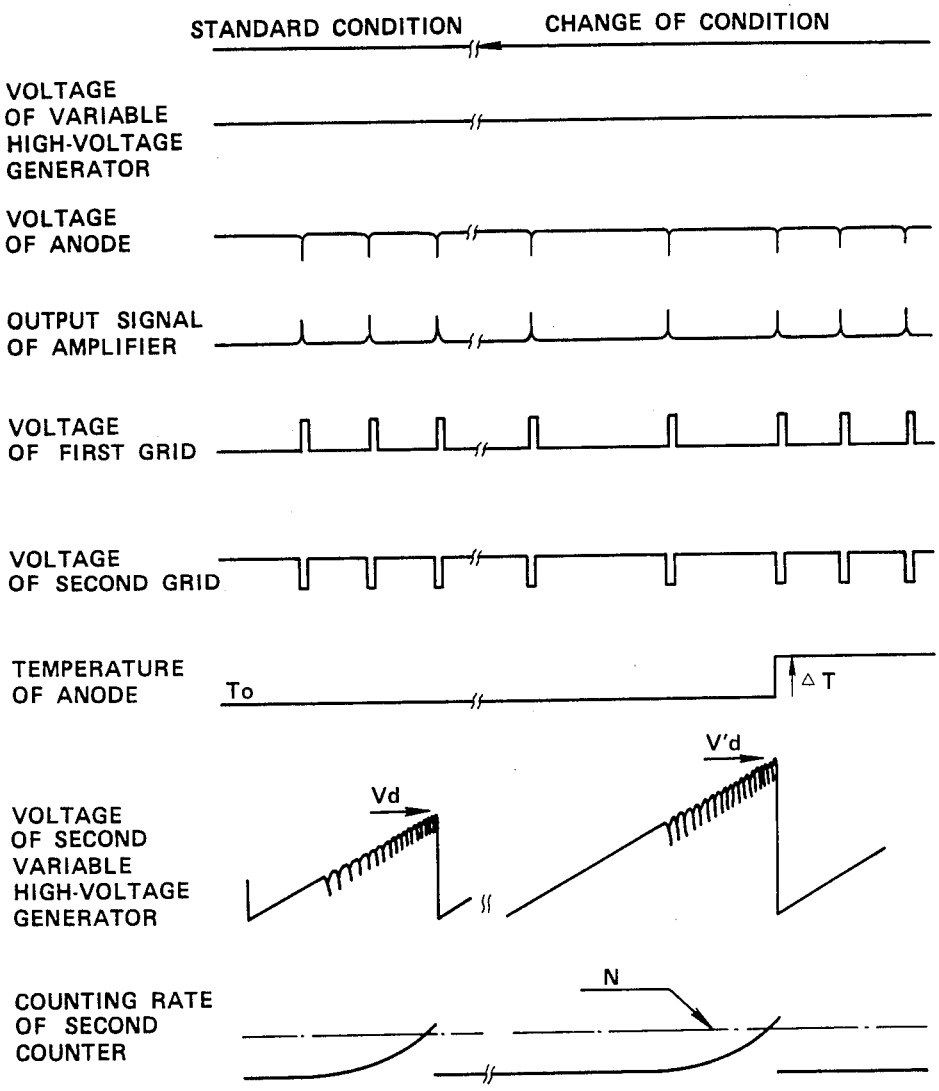
FIG. 9 is a diagrammatic representation of the operation of the apparatus shown in FIG. 8.

With the above arrangement, operation of the low-speed electron detector 1 of this embodiment will be described in reference to the characteristic curves shown in FIG. 9.

Assuming now that the current standard ambient condition has changed to 0° C. in temperature and 836 mmHg, the anode 62 of the ambient condition detector 66 is affected so that the gaseous discharge occurs at relatively higher anode voltages, with a resultant comparatively lower counting rate. Moreover, the anode 6 of the low-speed electron detector 1 requires a correspondingly higher anode voltage to cause gaseous discharge for the same counting rate, as will be seen from comparison of curves II and III in FIGS. 10(*a*) and 10(*b*).

Under the changed ambient operating condition, for the same counting rate, the gaseous discharge must occur at higher anode voltage Vd' rather than at the previous level Vd in the ambient condition detector 66. Thus, when the second counter 76 reaches its predetermined counting rate N, the second variable high-voltage generator 68 stops the sweep at voltage level Vd', and outputs that level Vd' to the control circuit 80.

The control circuit 80 increases the voltage to the anode 6 of the low-speed electron detector 1 in proportion to the output Vd' from the second generator 68, raising the anode temperature by a degree that is a function of $\Delta T$ ($=Vd'-Vd$). The raised temperature of the anode 6 heats the molecules within the inter-electrode space of the cathode 2 allowing the electrons present to move with increased freedom to such a degree that gaseous discharge is caused to occur at the same counting rate as under the standard ambient condition.

It will be appreciated from the above that the low-speed electron detector, in either of the second and third embodiments, can operate with a particular constant counting rate that can be maintained regardless of changes in the ambient temperature and the atmospheric pressure.

Figure 12:
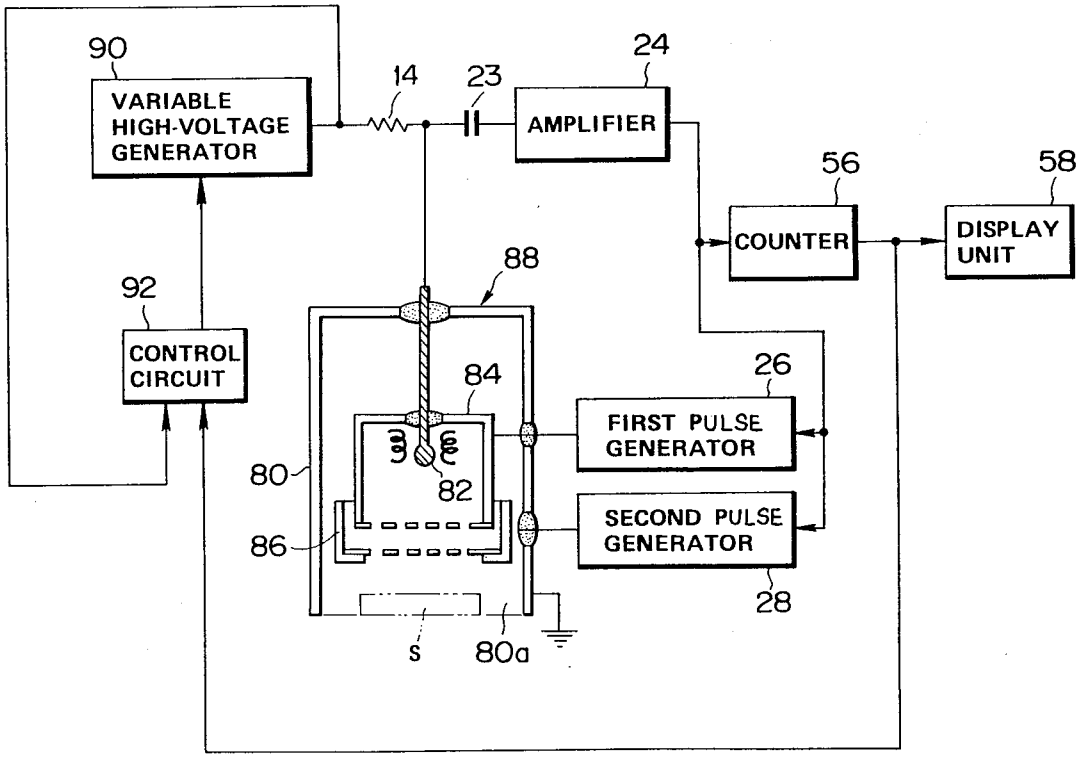
FIG. 12 is a block diagram of an apparatus for low-speed electron detection according to a fourth embodiment of this invention.

In FIG. 12, an apparatus for detecting low-speed electrons in accordance with a fourth embodiment of the present invention is shown. The low-speed electron detector 88 consists in the main of a bell-shaped cathode 80 having an inter-electrode space opened to the atmosphere through an opening 80*a* defined at the bottom thereof, an anode 82 supported in the space of the cathode 80 and adapted to produce a non-uniform electric field in the space, and a pair of first and second grids 84 and 86 mounted in a vertically spaced-apart relationship below the anode 82.

The low-speed electron detector 88 of this embodiment is constructed to possess the function of an ambient condition detector.

The anode 82 is connected through a load resistance 14 to a variable high-voltage generator 90 which supplies the anode 82 with a voltage that sustains in the inter-electrode space of the cathode 80 a strong electric field sufficient to cause gaseous discharge upon the entrance of low-speed electrons into the space. The first grid 84 is connected to a first pulse generator 26 which normally supplies the grid 84 with a voltage of around 100 volts. Further, the first pulse generator 26 is designed to feed a voltage of around 400 volts for a predetermined time interval Te to the grid 84 in response to the pulse signal output from an amplifier 24.

The second grid 86, on the other hand, is connected to a second pulse generator 28 which normally supplies the grid 86 with a voltage of 80 volts. Likewise, the second pulse generator 28, in response to the pulse signal from the amplifier 24, feeds the grid 86 a negative voltage of −30 volts for time interval Te.

It is so designed that the detector 88, in operation, first takes a first mode and then a second mode. In the first mode, the apparatus 88 monitors ambient operating environment where entrance of the low-speed electrons into the inter-electrode space of the cathode 80 is prevented. In the second mode, detection of the low-speed electrons emitted from the specimen S is started.

A control circuit 92 is connected to the variable high-voltage generator 90 for controlling the voltage output of the grid to the anode 82. In the first mode of the apparatus 88, the anode 82 is supplied with an increasing or decreasing range of voltages by the generator 90 until the number of pulses generated by the anode 82 as a result of gaseous discharge in the space reaches a predetermined rate N as observed by a display unit 58. At the moment when this rate is reached, the control circuit 92 reads the voltage level output from the variable high-voltage generator 90 to the anode 82. In the second mode, according to this voltage level Vd, the control circuit 92 controls the generator 90 to supply the anode 82 with a voltage that insures a particular constant counting rate.

Figure 13:
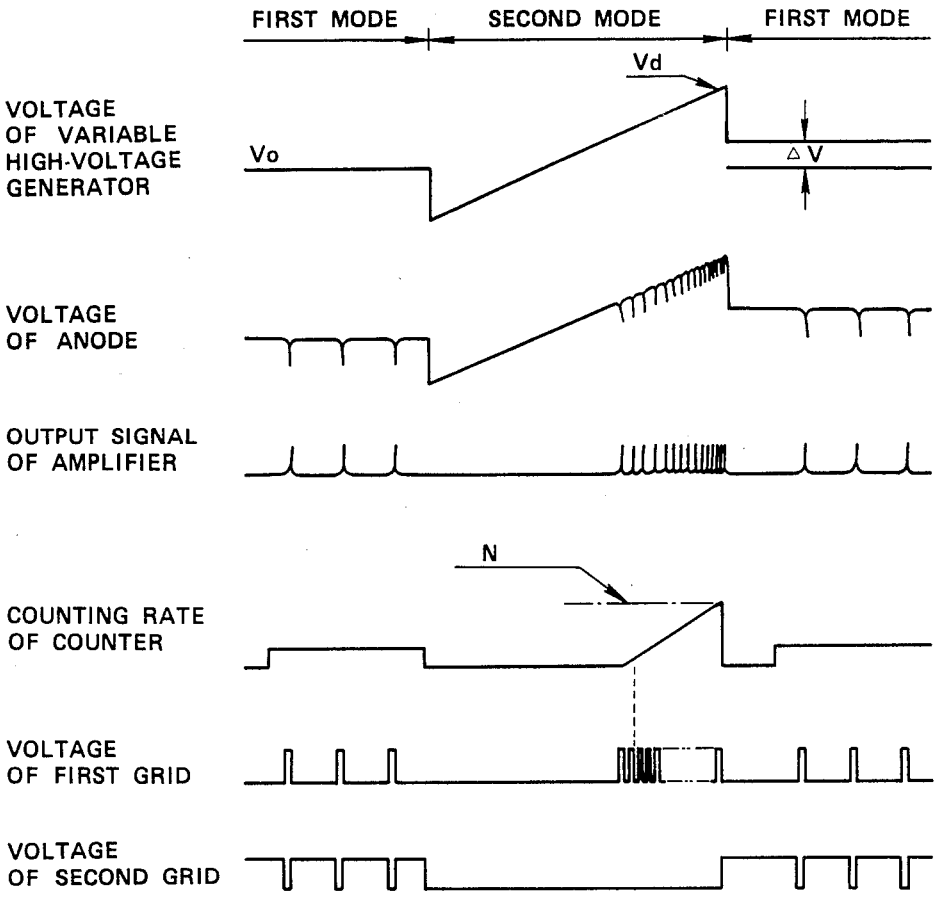
FIG. 13 is a diagrammatic representation of the operation of the apparatus shown in FIG. 12.

With the above construction, operation of the apparatus 88 will be described in reference to the characteristic curves shown in FIG. 13.

Assume now that the operating environment of the apparatus 88 stands at 20° C. in ambient temperature and 760 mmHg in atmospheric pressure.

When the apparatus 88 is started, with the specimen S being placed below the opening 80*a* of the cathode 80, the low-speed electrons emitted from the surface of the specimen S, pulled by the attractive forces exerted by the anode 82, move through the second and first grids 86 and 84 into the strong electric field of the anode 82 where they are accelerated causing a gaseous discharge in the inter-electrode space of the cathode 80. As a result, the anode voltage drops abruptly, causing the anode 82 to generate a series of pulses. The counter 56 counts these pulses and the display unit 58 displays the counting rate and number of emitted specimen low-speed electrons.

These anode pulses are also input to both the first pulse generator 26 and the second pulse generator 28. As a result, the first pulse generator 26 outputs an increased voltage of 400 volts for time interval Te, instead of the normal 300 volts, to the first grid 84 which acts to extinguish the gaseous discharge in the cathode inter-electrode space. Further, the second pulse generator 28 supplies the second grid 86 with a negative voltage of −30 volts, instead of the normal 80 volts. The negative voltage of the second grid 86 neutralizes the positive ions generated by the gaseous discharge in the space.

In this manner, the apparatus 88 restores back to its original state, at the end of time interval Te, where the anode voltage induces gasoues discharge at a constant counting rate.

Assuming now that the operating environment of the apparatus 88 has changed to 0° C. in ambient temperature and 836 mmHg in atmospheric pressure, affecting the anode 82, the same counting rate must consequently be insured by higher anode voltages than in the above standard ambient condition.

First, the detector 88 is set to a first mode where entrance of the low-speed electrons from the specimen S into the inter-electrode space is inhibited. This mode may be achieved by any suitable method. For example, the second grid 86 may be supplied with negative voltages.

Figure 16:
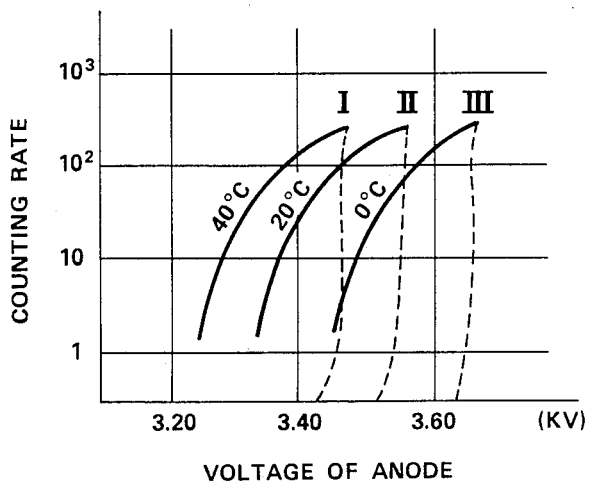
FIGS. 16*a* and 16*b* show in two diagrams the relationships between counting rate and detector anode voltage with and without low-speed electrons in the inter-electrode space, at different ambient temperatures I, II, and III (diagram "a") and at different atmospheric pressures I, II, and III (diagram "b").
Figure 16:
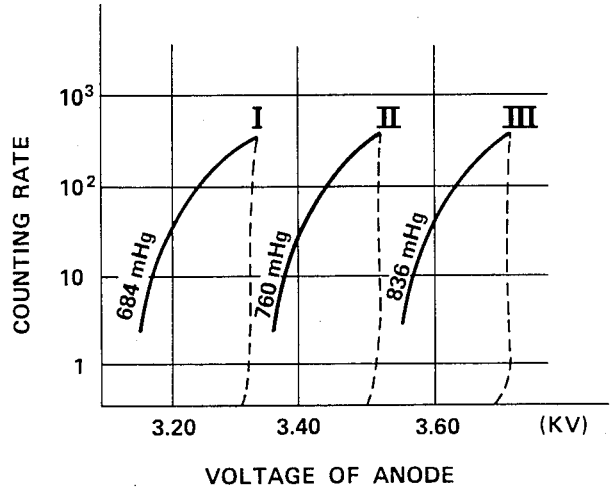

The control circuit 92 causes the variable high-voltage generator 90 to supply the anode 82 with, for example, an increasing voltage, starting from a level that induces no gaseous discharge in the cathode space. When the anode voltage increases to a sufficiently high level for gaseous discharge, the anode 82 begins to induce self-sustaining discharge, as indicated by dotted lines III in FIGS. 16(*a*) and 16(*b*), causing the amplifier 24 to start outputting pulses at a rate that is proportional to the progress of gaseous discharge in the cathode space.

The counter 56 counts the number of pulses output by the amplifier 24 and outputs the count to the control circuit 92. When the control circuit 92 detects a match between the count output from the ounter 56 and the predetermined counting rate N, it causes the variable high-voltage generator 90 to lock its voltage level Vd′ it is supplying the anode 82 just at that moment. This anode voltage level Vd′ represents the gaseous discharge conditions, as indicated by dotted lines III in FIGS. 16(*a*) and 16(*b*), that are themselves determined by the current ambient condition of 0° C. in ambient temperature and 836 mmHg in atmospheric pressure.

Now, the apparatus 88 is set to the second mode for detecting the low-speed electrons emitted from the specimen S. The control circuit 92 adjusts the output voltage from the variable high-voltage generator 90 to the anode 82 increasing it by an amount $\Delta V$. As a result, the apparatus 88 can operate with the same counting rate as in the above standard ambient condition.

Figure 14:
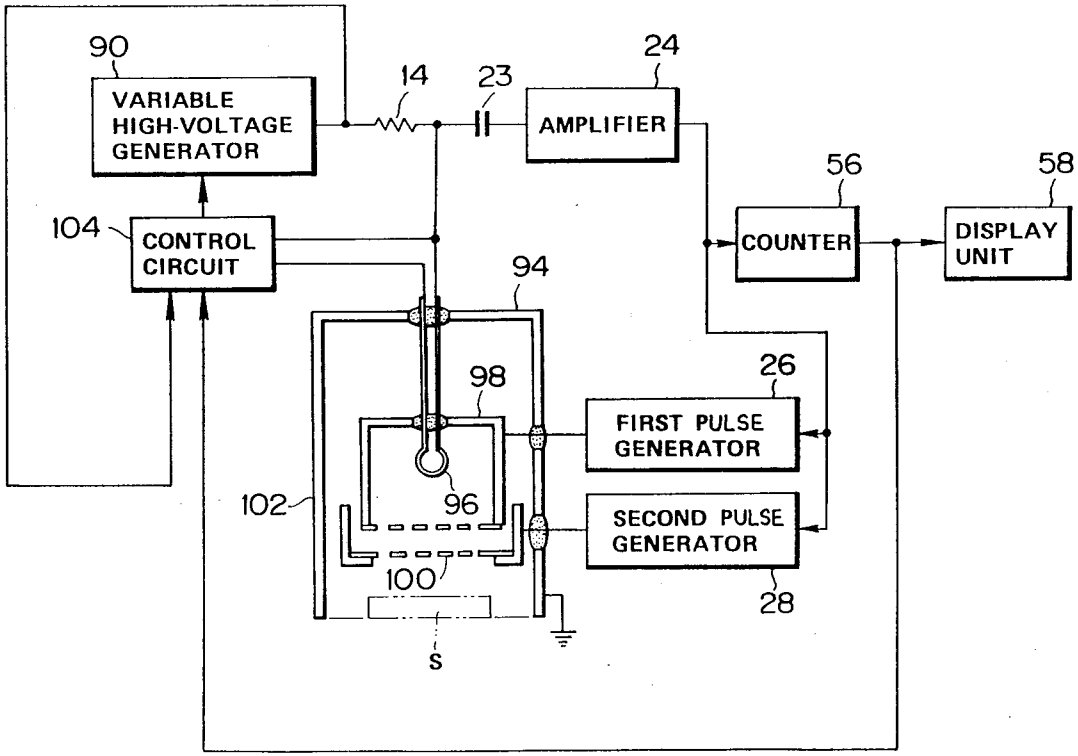
FIG. 14 is a block diagram of an apparatus for low-speed electron detection according to a fifth embodiment of this invention.

In FIG. 14, an apparatus for low-speed electron detection according to a fifth embodiment of the present invention is illustrated. The apparatus 102 of this embodiment is also constructed to have the function of an ambient condition detector.

The apparatus 102 consists in the main of a cathode 94 and an anode 96 supported in the inter-electrode space of the cathode 94. The anode 96 is formed largely into a ring, made of conductive wire, and is connected to a control circuit 104 through its two terminals 96*a* and 96*b*. The control circuit 104 controls the temperature of the anode 96 in a manner as will later be described. Also, the anode 96 is connected to a variable high-voltage generator 90 which supplies the anode 96 with a voltage that sustains in the cathode inter-electrode space a strong electric field sufficient to cause gaseous discharge in the presence of a low-speed electron in the space.

The apparatus 102 also takes alternate first and second modes. In the first mode, the apparatus monitors the conditions of its operating environment in terms of ambient temperature and atmospheric pressure. In the second mode, on the other hand, the apparatus 102 detects the low-speed electrons emitted from a specimen S.

The control circuit 104 adjusts the anode temperature in response to the output of the variable high-voltage generator 90 as a function of the anode voltage level Vd that, in the first mode, induces a gaseous discharge at a predetermined counting rate N as observed by the counter 56, so that adjusted temperature of the anode 96 can insure operation with the same counting rate in the second mode, regardless of changes in ambient temperature and atmospheric pressure.

Figure 15:
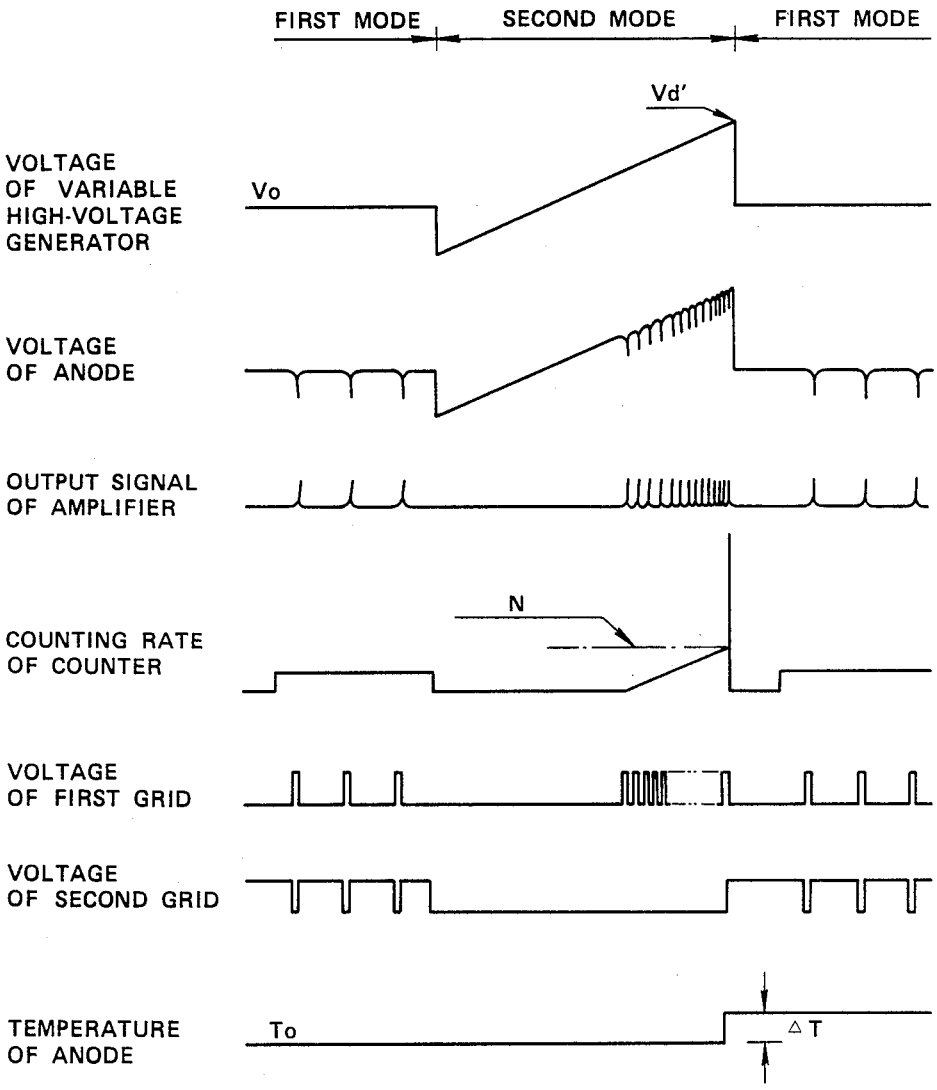
FIG. 15 is a diagrammatic representation of the operation of the apparatus illustrated in FIG. 14.

With the above arrangement, operation of the low-speed electron detector 102 of the present embodiment will be described in reference to the characteristic curves shown in FIG. 15.

Assuming now that the operating environment of the apparatus 102 has changed from the standard ambient condition to 0° C. in ambient temperature and 836 mmHg in atmospheric pressure.

First, the detector 102 is set to a first mode where entrance of the low-speed electrons from the specimen S into the cathode inter-electrode space is prevented. This may be achieved by any known method. For example, the second grid 100 may be supplied with negative voltages.

The control circuit 104 causes the variable high-voltage generator 90 to output an increasing voltage to the anode 96. When the anode voltage increases to a level high enough for gaseous discharge, the anode 96 begins to induce self-maintaining discharge, causing the amplifier 24 to start outputting pulses at a rate that is proportional to the number of gaseous discharges occurring in the cathode space.

The counter 56 counts these pulses as they are output by the amplifier 24, and outputs its count to the control circuit 104. When the control circuit 104 detects a match between this count and the predetermined counting rate N, it causes the generator 90 to lock its supply voltage level it is supplying the anode 96 just at that moment. This voltage level Vd' represents the ambient conditions and is taken by the control circuit 104 as a control parameter. The control circuit 104, based on this parameter, adjusts the output of the generator 90 to the anode 96, increasing the anode voltage by a rate $\Delta T$ ($=Vd'-Vd$). This increased anode voltage affects the molecules in the surrounding space allowing the electrons to move with increased freedom, to a degree which can be represented by curves II in FIGS. 16(*a*) and 16(*b*) for the standard ambient condition. Consequently, the apparatus 102 can operate with the same counting rate.

When the apparatus is operated in an extreme ambient condition (very high ambient temperature and/or very low atmospheric pressure), detection with less error of measurement will be insured if the apparatus is first operated with anode voltages for the initial condition in the first mode.

Although, in the fourth and fifth embodiments, switch from the first mode to the second mode is done manually, it may be accomplished by automatic means such as a timer.

The low-speed electron detector in either of the fourth and fifth embodiments can operate with constant high accuracy, regardless of changes in ambient temperature and atmospheric pressure, without using extra means for monitoring the operating environment or operational means. In them, the anode voltage in the second mode is determined based on the value of a control parameter that represents what significantly affects the state of the gaseous discharge in the cathode inter-electrode space. This control parameter value is defined as a function of the voltage value at which the increasing or decreasing anode voltage arrives just at the moment a particular counting rate has been reached in the first mode.

In addition, in the second through the fifth embodiments, although the anode voltage is varied from a lower to higher value, it may as well be changed from higher to lower. In this case, the output voltage of the variable high-voltage generator 90 may be controlled according to the anode voltage level at the moment when the observed counting rate reduces to the predetermined value. Further, with respect to the detector with means for controlling the temperature of the anode (the third and fifth embodiments), in controlling the output of the control circuit 10 for adjusting the anode temperature according to a ramp function, the voltage level that just starts to induce gaseous discharge may be employed as a control parameter.

Moreover, in the second through the fifth embodiments, detection of the varying state of gaseous discharge depending on operating environment is based on changes in the counting rate. However, it may as well as based on the amplitude of pulses output from the anode or the magnitude of anode load current.

Figure 3:
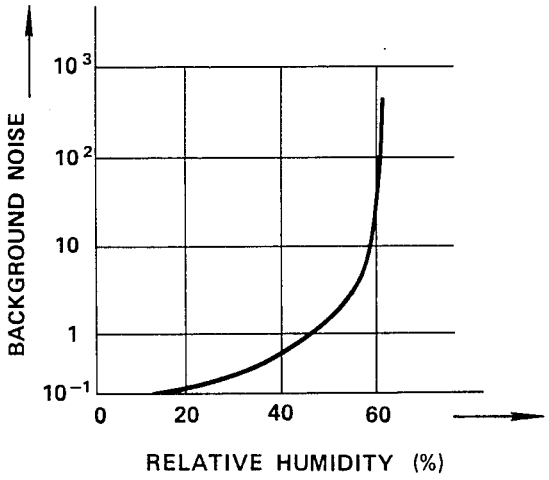
FIG. 3 shows in diagrammatic form the relationship between background noise and relative humidity.
Figure 4:
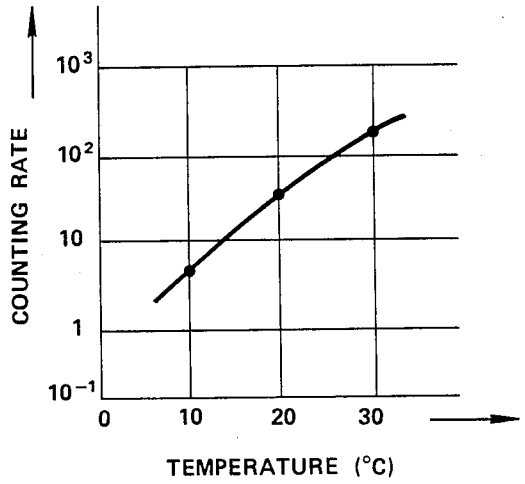
FIG. 4 plots the relationship between counting rate and ambient temperature.
Figure 5:
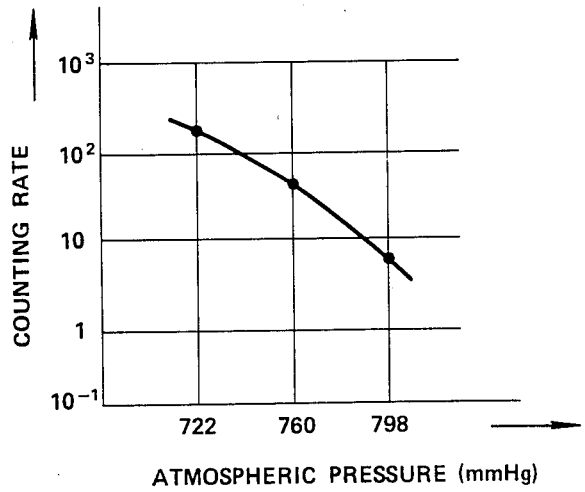
FIG. 5 plots the relationship between counting rate and atmospheric pressure.

Furthermore, in the first, the third and the fifth embodiments, since the anode is maintained at a constantly high temperature of around 100° C., even if relative humidity increases in the atmosphere, the apparatus can be operated within low ranges of background noise due to the presence of water vapor, as indicated in FIG. 3, with the surrounding of the anode being maintained at comparatively low relative humidity. In addition, high temperature in the surrounding of the anode increases freedom with which the electrons move, decreasing the anode voltage that can start to induce gaseous discharge so that power consumption of high-voltage generator can be reduced.

The embodiments described so far are preferred ones only and have been explained by way of example; and many modifications and combinations of parts will occur to those skilled in the art, without departing the spirit of the present invention. Therefore, this invention should be limited only by the scope of the appended claims.

What is claimed is:

1. An apparatus for detecting low-speed electrons, comprising a bell-shaped cathode opened at the bottom thereof to permit entrance of low-speed electrons, an anode supported within said cathode, a source of high voltage connected to said anode and adapted to supply said anode with a high voltage sufficient to induce gaseous discharge upon the entrance of the low-speed electrons, a means for heating said anode, and a sensor means for detecting parameters representative of the operating environment in which said apparatus is operated, said sensor means being adapted to output a signal indicative of the detected parameters, and a control means connected to both said heating means and said sensor means for adjusting the output of said heating means in response to the signal from said sensor means.

2. An apparatus set forth in claim 1, wherein said sensor means comprise at least one selected from the group of sensors for monitoring atmospheric pressure and ambient temperature.

3. An apparatus set forth in claim 1 or 2, wherein said anode is formed into a ring shape with extended terminals.

4. An apparatus set forth in claim 1 or 2, wherein said heating means is a heater mounted adjacent to said anode.

5. An apparatus for detecting low-speed electrons, comprising:

a low-speed electron detector means including a bell-shaped electron detector cathode opened at the bottom there of to permit entrance of the low speed electrons into the cathode, an electron detector anode supported within said cathode, and a first variable high-voltage generator means adapted to supply said anode with a variable high voltage sufficient to induce a gaseous discharge upon the entrance of the low-speed electrons into said cathode;

an ambient condition detector means including a bell-shaped condition detector cathode having an opening designed to permit communication between the inside of said condition detector cathode and the atmosphere, said opening including means for preventing entrance of the low-speed electrons, a condition detector anode supported within said condition detector cathode, and a second variable high-voltage generator means adapted to supply said condition detector anode with a variable high voltage sufficient to induce a gaseous discharge in said condition detector cathode; and control means for controlling said second variable high-voltage generator means to output an increasing or decreasing voltage and detect the voltage level at said anode of said ambient condition detector means just at the moment when the discharge undergoes a particular change in said ambient condition detector means, said control means being adapted to control the output of said first variable high-voltage generator means in response to the value of said detected voltage level.

6. An apparatus for detecting low-speed electrons, comprising:

a low-speed electron detector including a bell-shaped electron detector cathode opened at the bottom thereof to permit entrance of low-speed electrons into said cathode, an electron detector anode supported within said cathode, a first variable high voltage generator means adapted to supply said anode with a variable high voltage sufficient to induce a gaseous discharge upon the entrance of the low-speed electrons into the cathode, and a heating means adapted to heat said anode to a controlled temperature;

an ambient condition detector means including a bell-shaped condition detector cathode having an opening designed to permit communication between the inside of said condition detector cathode and the atmosphere, said opening including means for preventing entrance of the low-speed electrons into said condition detector cathode, a condition detector anode supported within said condition detector cathode, and a second variable high voltage generator means adapted to supply said condition detector anode with a varriable high voltage enough to induce a gaseous discharge in said condition detector cathode sufficient to induce a gaseous discharge in said condition detector cathode; and control means for controlling said second variable high voltage generator means to output an increasing or decreasing voltage and detect the voltage level at said anode of said ambient condition detector means just at the moment when the discharge undergoes a particular change in said ambient condition detector means, said control means being adapted to control said heating means so as to adjust the temperature of said anode of said low-speed electron detector means to such a level that can trigger a certain amount of discharge.

7. An apparatus set forth in claim 6, wherein said anode of low-speed electron detector is formed into a ring with extended terminals.

8. An apparatus set forth in claim 6 or 7, wherein said heating means is a heater mounted adjacent to said anode in said low-speed electron detector means.

9. An apparatus for detecting low-speed electrons, comprising a bell-shaped cathode having an opening formed at the bottom to permit communication between the inside of said cathode and the atmosphere, said opening being adapted to permit, in a first mode, and prevent, in a second mode, entrance of the low-speed electrons into said cathode, an anode supported in said cathode, a variable high-voltage generator means for supplying said anode with a variable high voltage enough to induce a gaseous discharge in said cathode upon the entrance of the low-speed electrons, and a control means for controlling said variable high-voltage generator means to output an increasing or decreasing voltage and detect the voltage level at said anode just at the moment when the discharge undergoes a particular change in said first mode, said control means being adapted to control the output of said variable high-voltage generator means to supply a high voltage enough to induce a particular amount of a gaseous discharge upon the entrance of the low-speed electrons in said second mode.

10. An apparatus for detecting low-speed electrons, comprising a bell-shaped cathode having an opening formed at the bottom thereof to permit communication between the inside of said cathode and the atmosphere, said opening being adapted to permit, in a first mode, and prevent, in a second mode, entrance of the low-speed electrons into said cathode, an anode supported in said cathode, a variable high voltage generator means for supplying said anode with a variable high voltage enough to induce in said cathode a gaseous discharge upon the entrance of the low-speed electrons thereinto, a heating means for heating said anode, and a control means for controlling said variable high voltage generator means to output an increasing or decreasing voltage and detect the voltage level at said anode just at the moment when the discharge undergoes a particular change in said first mode, said control means being adapted to control said heating means so as to heat said anode to a temperature that can induce a particular amount of gaseous discharge upon the entrance of the low-speed electrons into said cathode in said second mode.

11. An apparatus set forth in claim 10, wherein said anode of low-speed electron detector is made of wire formed into a ring shape with extended terminals.

12. An apparatus set forth in claim 10 or 11, wherein said heating means is a heater mounted adjacent to said anode.

* * * * *